US009433264B2

(12) United States Patent
Ingimundarson et al.

(10) Patent No.: US 9,433,264 B2
(45) Date of Patent: Sep. 6, 2016

(54) VERSATILE JEWELRY

(71) Applicants: Arni Thor Ingimundarson, San Diego, CA (US); Shireen Maria Thor, San Diego, CA (US)

(72) Inventors: Arni Thor Ingimundarson, San Diego, CA (US); Shireen Maria Thor, San Diego, CA (US)

( * ) Notice: Subject to any disclaimer, the term of this patent is extended or adjusted under 35 U.S.C. 154(b) by 0 days.

(21) Appl. No.: 14/996,666

(22) Filed: Jan. 15, 2016

(65) Prior Publication Data

US 2016/0157569 A1 Jun. 9, 2016

Related U.S. Application Data

(63) Continuation-in-part of application No. 14/495,022, filed on Sep. 24, 2014.

(60) Provisional application No. 61/944,148, filed on Feb. 25, 2014, provisional application No. 61/881,720, filed on Sep. 24, 2013.

(51) Int. Cl.

| | |
|---|---|
| ***A44C 5/12*** | (2006.01) |
| ***A44C 5/00*** | (2006.01) |
| ***A45D 8/36*** | (2006.01) |

(52) U.S. Cl.

CPC ..... *A44C 5/0007* (2013.01); *A44C 5/003* (2013.01); *A44C 5/0053* (2013.01); *A45D 8/36* (2013.01); *Y10T 29/4987* (2015.01); *Y10T 29/49826* (2015.01)

(58) Field of Classification Search

None

See application file for complete search history.

(56) References Cited

U.S. PATENT DOCUMENTS

| | | | | |
|---|---|---|---|---|
| 712,657 | A | 11/1902 | Davis | |
| 971,519 | A | 10/1910 | Brannen | |
| D77,688 | S | 2/1929 | Goldstein et al. | |
| 2,168,490 | A | 8/1939 | Moss | |
| 2,235,350 | A * | 3/1941 | Anderson | A44C 15/002 206/37 |
| D154,205 | S | 6/1949 | Kovacs et al. | |
| 2,653,402 | A | 9/1953 | Bonagura | |
| D180,713 | S | 7/1957 | Hammond | |
| D186,822 | S | 12/1959 | Goodman et al. | |
| 3,542,041 | A | 11/1970 | Mercorella | |
| 3,559,854 | A * | 2/1971 | Loveland | A44C 5/003 132/294 |
| 3,575,164 | A | 4/1971 | Heale | |
| 3,610,488 | A | 10/1971 | Tracy | |
| 3,842,849 | A | 10/1974 | Goodman | |

(Continued)

OTHER PUBLICATIONS

"Beautiful Tiffany & Co. Sterling Cuff Bangle Bracelet 1997 1837 w/ Box," design copyrighted 1997, available as early as Dec. 1, 2015 at http://www.ebay.com/itm/Beautiful-Tiffany-Co-Sterling-Cuff-Bangle-Bracelet-1997-1837-W-Box-/252188042627?hash=item3ab7942583:g:QDsAAOSwo0JWN7GR, 7 pages.

*Primary Examiner* — Jack W Lavinder

(74) *Attorney, Agent, or Firm* — Workman Nydegger

(57) ABSTRACT

A versatile jewelry includes a semi-rigid or rigid main body defining groove about the outer periphery. The groove has a varying depth along its length and defines a cross section including a flat bottom portion and a pair of flat upstanding sidewalls. The main body has a semi-elliptical profile and defines first and second opposing end portions with a clearance therebetween. At least one hair accessory having an elasticity is adapted to be disposed in the groove and span the periphery of the main body and the clearance. The main body has a rigidity arranged to distribute pressure from the at least one hair accessory away from the wrist and the elasticity of the at least one hair accessory is arranged to force the at least one hair accessory against the bottom portion of the groove and the sidewalls restrict lateral movement of it within the groove.

17 Claims, 9 Drawing Sheets

(56) References Cited

U.S. PATENT DOCUMENTS

| | | | |
|---|---|---|---|
| 5,044,385 | A | 9/1991 | Rhodes |
| D322,145 | S | 12/1991 | Coignard |
| 5,081,852 | A | 1/1992 | Cox |
| 5,186,186 | A | 2/1993 | Hamilton |
| 5,379,782 | A | 1/1995 | Tabb |
| 5,456,270 | A | 10/1995 | Wong |
| 5,495,861 | A | 3/1996 | Liberman |
| 5,535,765 | A | 7/1996 | Takashima |
| D377,196 | S | 1/1997 | Sheppard, Jr. |
| 5,590,668 | A | 1/1997 | Macy |
| D389,423 | S | 1/1998 | Wein |
| 5,706,837 | A | 1/1998 | Iwata |
| D390,150 | S | 2/1998 | Wein |
| 5,727,574 | A | 3/1998 | Frye |
| 5,769,101 | A | 6/1998 | Iwata |
| 5,826,593 | A | 10/1998 | Haubrich |
| 5,829,457 | A | 11/1998 | Huang |
| 5,901,713 | A | 5/1999 | Mroczek |
| 5,927,297 | A | 7/1999 | Cooper |
| 6,000,408 | A | 12/1999 | Maturaporn |
| 6,003,521 | A | 12/1999 | Huang |
| 6,047,708 | A | 4/2000 | Panel et al. |
| 6,050,272 | A | 4/2000 | Droin |
| D428,670 | S | 7/2000 | Tsai |
| 6,142,159 | A | 11/2000 | Lloyd |
| 6,260,383 | B1 | 7/2001 | Warren et al. |
| 6,267,120 | B1 | 7/2001 | Serignat |
| 6,276,368 | B1 | 8/2001 | Giamalva |
| 6,276,369 | B1 | 8/2001 | Rogers |
| 6,295,992 | B1 | 10/2001 | Sapp |
| 6,311,699 | B1 | 11/2001 | Horman |
| 6,401,726 | B1 | 6/2002 | Sonstegard |
| 6,427,701 | B1 | 8/2002 | Roth |
| 6,439,242 | B1 | 8/2002 | Head et al. |
| 6,484,728 | B1 | 11/2002 | Chang |
| D468,190 | S | 1/2003 | Kennedy et al. |
| 6,513,535 | B1 | 2/2003 | Lane |
| 6,601,590 | B2 | 8/2003 | Neary |
| 6,880,364 | B1 | 4/2005 | Vidolin et al. |
| 6,990,736 | B2 | 1/2006 | West |
| 7,004,179 | B1 | 2/2006 | Lunde |
| 7,017,589 | B1 | 3/2006 | Minnelli |
| 7,140,063 | B2 | 11/2006 | Osborne |
| 7,543,460 | B2 | 6/2009 | Cruise et al. |
| 7,581,548 | B2 | 9/2009 | Henricksen et al. |
| D603,287 | S | 11/2009 | Dzurek |
| 7,963,289 | B1 | 6/2011 | King |
| D646,600 | S | 10/2011 | Minkkinen et al. |
| 2002/0162564 | A1 | 11/2002 | Head et al. |
| 2004/0164034 | A1 | 8/2004 | Costanza |
| 2005/0097921 | A1 | 5/2005 | Maruyama |
| 2006/0174650 | A1 | 8/2006 | Phillips et al. |
| 2009/0145454 | A1 | 6/2009 | Saponaro et al. |
| 2009/0288673 | A1 | 11/2009 | Park |
| 2010/0078036 | A1 | 4/2010 | Naji |
| 2010/0180911 | A1 | 7/2010 | Kraft et al. |
| 2013/0133365 | A1 | 5/2013 | Zannella |
| 2014/0318180 | A1 | 10/2014 | Cabe |
| 2015/0082830 | A1 | 3/2015 | Ingimundarson |

* cited by examiner

VERSATILE JEWELRY

FIELD OF ART

This disclosure relates to versatile jewelry having a combination of aesthetic and functional purposes, and to a versatile jewelry arranged to protect an arm or wrist from poor blood circulation, pressure marks, and a carrier to maintain hair accessories while providing aesthetically pleasing properties.

BACKGROUND

Many individuals wear a hair tie, such an elastic band, to keep their hair away from their face during certain activities. This style has also become fashionable where putting the hair into a ponytail presents a different look. The elastic band industry has grown tremendously with different styles, colors and sizes and elasticity being offered. Many individuals like to change their style throughout the day, wearing their hair down or putting it into a ponytail, depending on the look or functional activity they are performing. This poses an issue where an elastic band must keep the hair up, but it can easily get lose if being taken on and off constantly. This has caused many individuals to wear an elastic band around their wrist to ensure that they always have one around when needed.

A problem with wearing an elastic band is both the appearance, such as when an individual dresses up, and physical impact, such as forming a mark on the wrist due to the elastic band tightly fitting to a wrist and possible restriction in circulation of the arm. Solutions are offered to address the aesthetic part with many styles of elastic bands offered in different colors and with jewelry attached to the band but few if any solutions exist that properly address both issues at the same time; providing an aesthetically pleasing look and protecting the wrist from marks and poor circulation.

US patent application publication 2013/0133365, published May 30, 2013, describes a fully circumferential bracelet with a channel to wear a hair tie. Due to the circumferential design, the hair tie is located away from the wrist in a channel groove defined by the bracelet. Due to the inherent circumferential shape of the bracelet, it is difficult to remove the hair tie from the bracelet.

To solve this issue, the publication describes providing spaced indents along the circumference of the channel groove of the bracelet to allow fingers to grab the hair tie and remove it from the bracelet. These indents are not aesthetically pleasing and make the bracelet complicated, bulky and aesthetically limited. The indents prohibit or significantly reduce the ability to configure the bracelet with attractive features that make each bracelet unique in appearance because all bracelets made under the publication are recognized with the indents and must have significant bulk to accommodate such indents.

A significant trend is tracking activity with activity monitors. These activity monitors have been integrated into bracelets that also serve an aesthetic purpose. Certain companies promoting these type of bracelets include Nike with Fuelband, Fitbit and Jawbone. Technology of activity monitoring seems is similar, and companies differentiate on design and branding. A large segment of customers are young, active individuals. These users must remember to bring a hair tie to the gym and sometime wear them around their wrist so they don't forget them when they need them.

SUMMARY

Embodiments of the disclosure involve a versatile jewelry with an aesthetically pleasing look having an attachment point or retaining features for one or more hair accessories, such as a hair tie or elastic band, to maintain it in place and provide a distribution of pressure from the force created by the tension of the hair accessory, partially or completely around the wrist.

Embodiments of the versatile jewelry, such as a bracelet, preferably include an "open cuff" design, allowing for the bracelet to be low profile by sitting close to the wrist. The configuration makes it easy to place over the wrist by slipping it directly onto the wrist instead of passing over the hand; it is easy to remove the hair accessory by pulling at it where the bracelet is open. The open cuff design may include the bracelet being rigid or semi-rigid, and enable opening the bracelet to don over the wrist or the hand. The bracelet is sufficiently rigid cuff to keep the hair accessory from applying much pressure on the wrist while looking aesthetically pleasing on the wrist and offering versatility of appearances.

The open design may include a variety of shapes and is not limited to a circular profile. The profile may be oval, semi-oval, square or comprise other possible shapes. The contours of the bracelet are not limited to being uniform but rather they may be irregular and may be streamlined without a necessity of indents to remove the hair accessory.

It will be understood that the bracelet is not limited to the open cuff design, but may include many of the features described that enable a "closed cuff" design to easily remove a hair accessory.

According to an embodiment, the versatile jewelry includes a semi-rigid or rigid main body defining at least one retaining feature about the outer periphery. The main body is preferably formed from a metal or plastic, whereas the at least one hair accessory may be formed from an elastic material. The main body has a semi-circular profile and defines first and second opposing end portions with a clearance therebetween. The at least one retaining feature may be a groove formed into the outer surface of the main body and extending about its length.

At least one hair accessory, such as a hair tie or elastic band, is adapted to extend over the main body and was secured by the at least one retaining feature. The main body retains the at least one hair accessory therewith and spans the periphery of the main body and the clearance. The semi-rigid or rigid body resists the elasticity of the elastic band.

The at least one of the first and second opposing end portions may define a troughed portion enclosing an end of the at least one retaining feature, and the first and second opposing end portions may each define a troughed portion enclosing the at least one retaining feature. The groove may terminate short of the first and second end portions, and the at least one hair accessory is arranged to extend over the first and second end portions. The first and second end portions may suspend the at least one hair accessory at a height above the at least one retaining feature across the clearance.

The main body may define upper and lower portions having decorative features. The upper and lower portions may have a non-uniform profile or contour bordering the at least one retaining feature. Alternatively, the decorative feature may result in a highly streamlined profile comprising substantially thinned upper and lower portions and a thin groove forming the at least one retaining feature. At least one of the upper and lower portions may include attractive features secured thereon such as diamonds, colored beads, crystals, and other known types, and which do not interfere with the at least one retaining feature, and do not impede removal of the at least one hair accessory.

The first end portion may enclose the at least one retaining feature and the second end portion may open to the at least one retaining feature. The at least one retaining feature may be a groove, the first and second end portions open to groove.

In another embodiment, the main body defines first and second ledges protruding from the first and second end portions outside the upper and lower portions, respectively, and as the bottom periphery of the groove.

In another embodiment, the main body defines a sleeve protruding from upper and lower rims along the upper and lower circumferential edges, respectively. The upper and lower rims may radially outwardly protrude from the at least one retaining feature defined as a retaining surface formed by the main body.

The sleeve may extend over the at least one retaining feature and the at least one hair accessory. The sleeve may define upper and lower segments spaced apart by a gap. The gap may have contours to prohibit slippage of the hair accessory from the sleeve, such as non-linear segments. The non-linear segments may include a decorative feature, such as a squiggly line or other decorative yet functional design. The sleeve may include attractive features such as those described above and other indicia or attractive features such as a name, brand or other motif.

According to a method for wearing versatile jewelry, the method may include the steps of providing a semi-rigid or rigid main body about a wrist of a wearer wherein the main body defines at least one retaining feature about the circumference thereabout and first and second end portions spaced apart by a clearance; placing at least one hair accessory over the main body; securing the at least one hair accessory to the at least one retaining feature with the first and second end portions suspending the at least one hair accessory over the clearance; and wherein the main body prevents the hair accessory from exerting pressure over the wrist at which the main body extends.

The main body may also contain an activity or general health monitor of some sort. This allows the active user that wants to track activity with an activity monitor also to keep her elastic handy when required for active use. The user may place hair in a ponytail when going to the gym but may keep the hair straight during other daily activities. Having such a channel in an activity monitor allows them to make the hair tie a part of the design, serve an aesthetic purpose and to always be handy when needed. Activity monitor companies can also use this feature as a differentiating factor when comparing themselves to the competition by creating a version of their activity monitor bracelet.

The numerous advantages, features and functions of the embodiments of the versatile jewelry will become readily apparent and better understood in view of the following description and accompanying drawings. The following description is not intended to limit the versatile jewelry but instead merely provides exemplary embodiments for ease of understanding.

BRIEF DESCRIPTION OF THE DRAWINGS

These and other features, aspects, and advantages of the present invention will become better understood regarding the following description, appended claims, and accompanying drawings.

In the figures, similar elements are provided with similar reference numbers. The drawing figures are not drawn to scale, or proportion, but instead are drawn to provide a better understanding of the components, and are not intended to be limiting in scope, but provide exemplary illustrations.

DETAILED DESCRIPTION OF VARIOUS EMBODIMENTS

Figure 1:
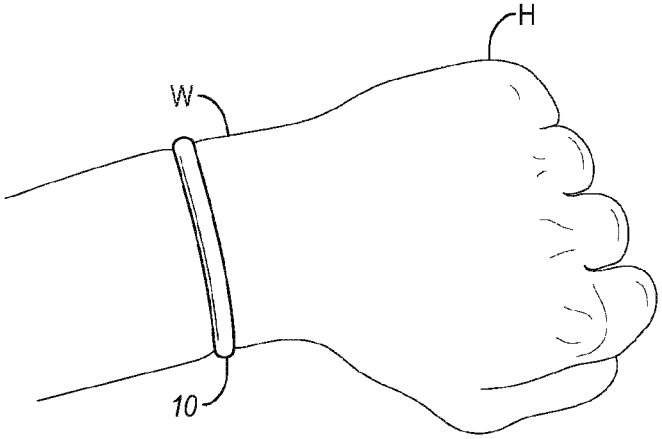
FIG. 1 (Prior Art)
FIG. 1 is a perspective view showing a prior art elastic band commonly worn around the wrist.

FIG. 1 shows a hair accessory or an elastic band 10 commonly worn by individuals that keep their hair flowing or in a ponytail through different times of the day. Keeping the elastic band on the wrist W by slipping it over the hand H ensures that it does not get lost and may be used by some as decoration.

Figure 2:
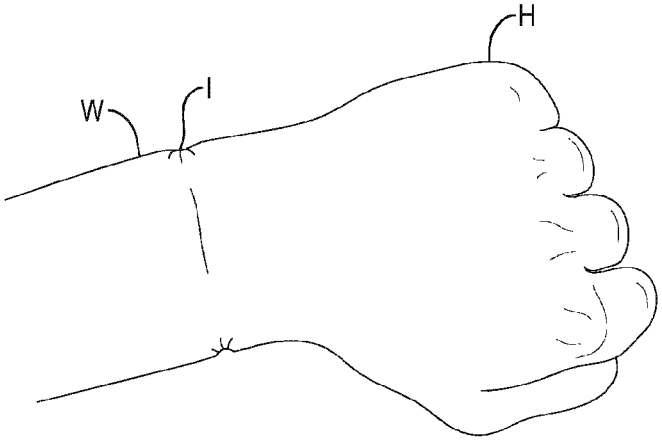
FIG. 2 is a perspective view showing a mark created from elastic band of FIG. 1 after minimal use.

An issue with wearing such an elastic band is shown in FIG. 2. The marks or indentation I left on the wrist are due to pressure exerted on the wrist W by the tension in the elastic band. The pressure leaves a mark, thereby creating discomfort and restricting circulation to the wrist W. There are times when one would not feel comfortable wearing just an elastic band on an arm, such as when wearing business attire or at an evening event where elegant clothing is essential. These individuals therefore must decide beforehand whether to keep their hair down or in a ponytail or else having to keep the band hidden in a pocket or a purse.

FIGS. 3A-7 show an exemplary embodiment 100 of the versatile jewelry. A main body 102 or bracelet partially wraps around the wrist W, and has a substantially smooth inner surface 128 arranged to be worn against a wrist. Material used in this bracelet can be any that holds its shape and distributes the pressure away from the wrist. Materials used can be silver, gold, steel, plastic, rubber, leather or any other material deemed usable to serve this purpose. The bracelet may be bent to shape to tightly conform to the user's wrist.

The bracelet 100 preferably includes an "open cuff" design, allowing for the bracelet to be low profile by sitting close to the wrist. The configuration makes it easy to place over the wrist by slipping it directly onto the wrist instead of passing it over the hand, and to remove the hair accessory by pulling at it where the bracelet in open. The open cuff design may include the bracelet being rigid or semi-rigid, and enabling opening the bracelet to don over the wrist or the hand. The bracelet is sufficiently rigid to keep the hair accessory from applying too much pressure on the wrist while looking aesthetically pleasing on the wrist and offering a variety of appearances.

The bracelet may be opened and due to the material of the bracelet being resilient, the bracelet returns to its original shape once it is released over the wrist. Alternatively, the bracelet may be elastic so that it is opened and then contracts over the wrist, such that the bracelet has a certain width to minimize concentration of pressure over the wrist.

Figure 11:
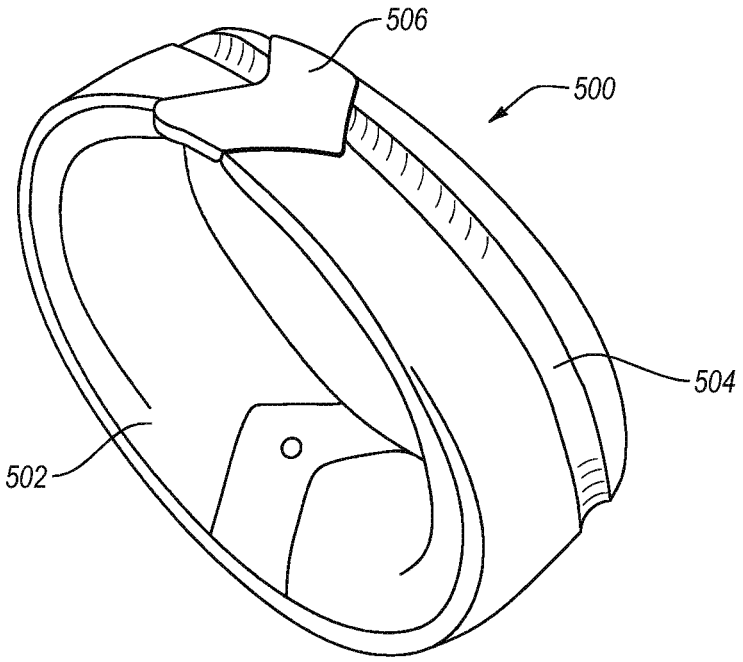
FIG. 11 is a perspective view showing another embodiment of a versatile jewelry having different colors.
Figure 12:
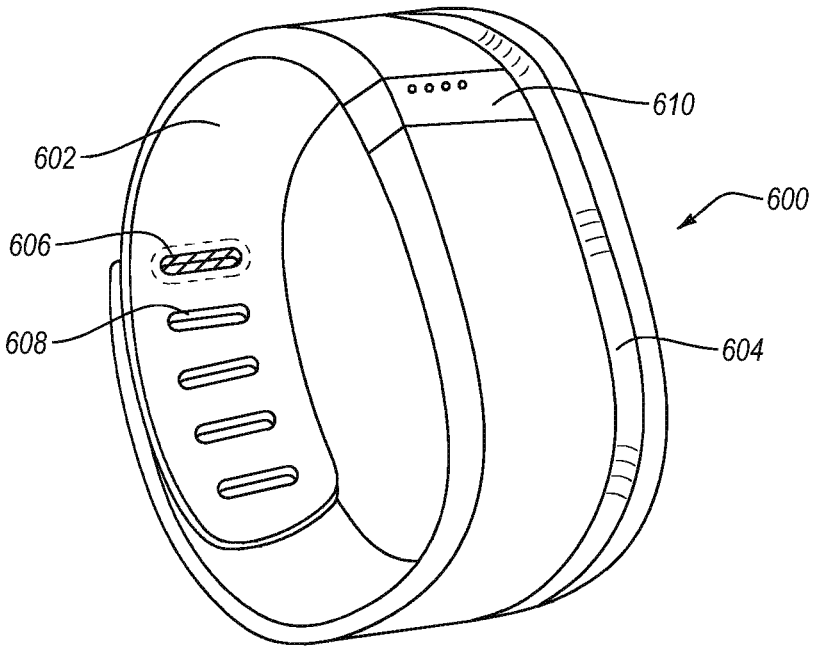
FIG. 12 is a perspective view showing another embodiment of a versatile jewelry.

The open cuff includes a clearance or opening 106 of the bracelet 100 allowing for the bracelet to be easily donned while ensuring that it stays well on the arm during any activity. The bracelet 100 can be circular but would then require a locking system that can allow access or to have the bracelet donned by putting the hand through the bracelet, as depicted in FIGS. 11 and 12. The retaining feature 112 may be in the form of a groove or channel 112 resembling the shape of the hair accessory, ensuring that the hair accessory stays within the confinement of the contour built into the bracelet 100. This method is not the only way the bracelet could be kept in place properly. Alternative methods such as: one or several hooks on bracelet; overlay or any built in shape that keeps the elastic in place; magnets inserted into bracelet and attached to elastic band; one or more ridges along the bracelet to ensure that one or more of the elastic bands do not move in place.

There may be a width of the bracelet formed between the upper and lower portions 114, 116 to ensure that the hair accessory does not slip from the bracelet 100 and therefore proper distribution of pressure from the hair accessory is ensured. If multiple hair accessories are worn, this can be solved by more than one groove or channel, or a wider channel to hold more than one hair accessory in the embodiments of 9A-9C.

From the exemplary examples, the versatile jewelry other than its ornamental design is to reduce the pressure applied by the elastic band on the wrist. The main body in a bracelet can completely lift the elastic band off the wrist or allow it to only apply a minimal amount of pressure in certain areas where the bracelet does not cover the arm.

According to the embodiment of FIGS. 3A-7, the versatile jewelry includes the semi-rigid or rigid main body 102 defining at least one retaining feature 112 defined about the outer periphery thereof between the first or upper and the second or lower portions 114, 116. The at least one hair accessory is preferably formed from an elastic material 104 but is not limited to elastic material and may comprise a tie or other element looped or secured to the main body 102. The main body has a semi-circular profile and defines first and second opposing end portions 108, 110 with a clearance 106 therebetween to form the open cuff design. The at least one retaining feature 112 may be a groove formed into the outer surface of the main body and extending about its length or circumference.

Figure 3A:
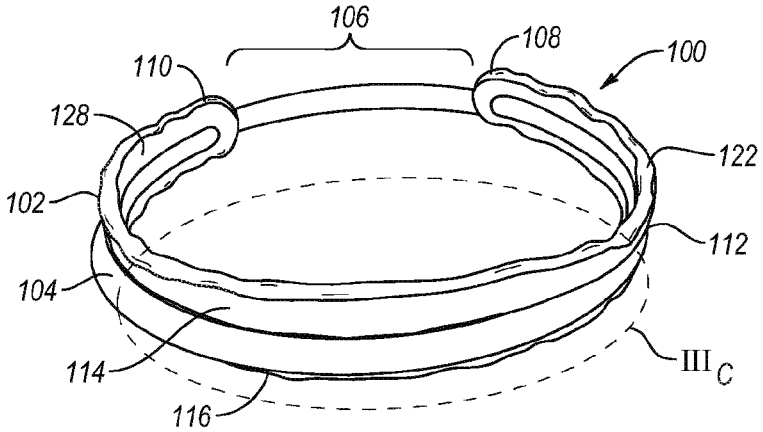
FIG. 3A is a front perspective view showing an embodiment of a versatile jewelry.
Figure 3B:
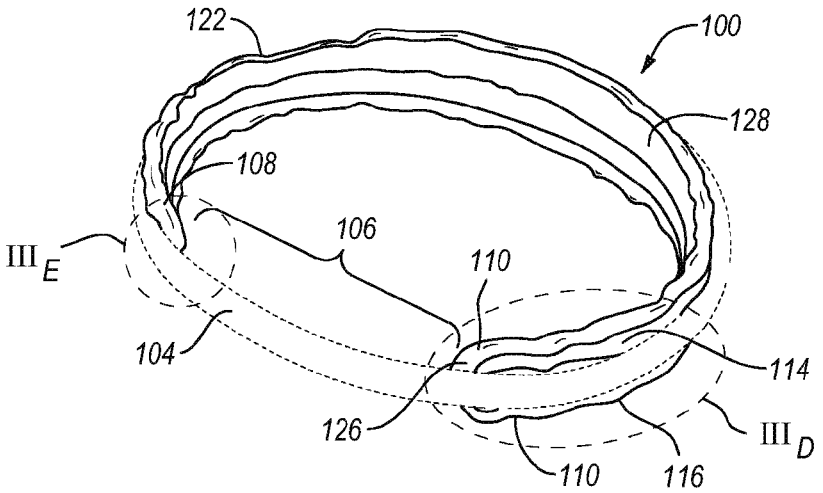
FIG. 3B is a rear perspective view of the embodiment of FIG. 3A.
Figure 3C:
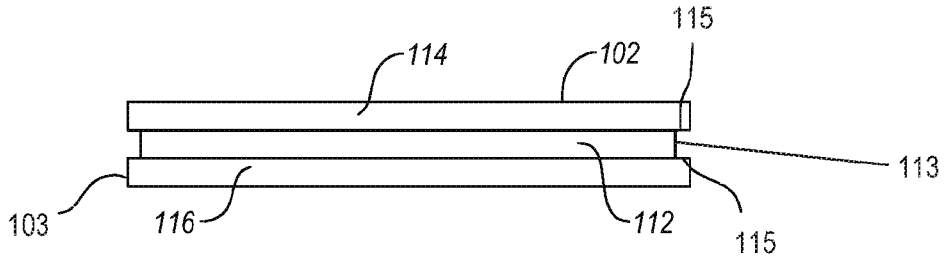
FIG. 3C is a front sectional view taken from the embodiment of FIG. 3A.

The groove 112 has a rectangular configuration as best seen in FIG. 3C including a bottom portion 113 and a pair of sidewalls 115 oriented substantially perpendicular to the bottom portion 113. The sidewalls 115 are substantially parallel to one another and extend between the bottom portion 113 and the outer surface 103 of the main body 102.

At least one hair accessory 104, such as a hair tie or elastic band, is adapted to extend over the main body 102 and arranged to be secured by the at least one retaining feature 112. The main body 102 retains the at least one hair accessory 104 therewith and spans the periphery of the main body 102 and the clearance 106. The semi-rigid or rigid body 102 resists the elasticity of the hair accessory 104.

Figure 3D:
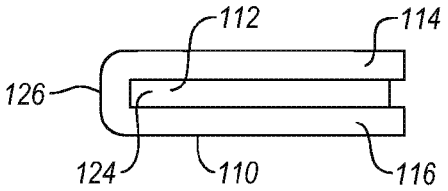
FIG. 3D is a top sectional view taken from FIG. 3B.
Figure 3E:
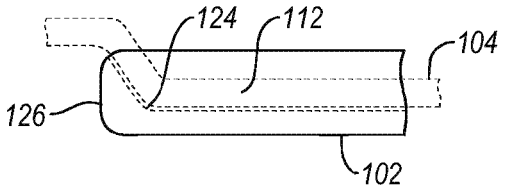
FIG. 3E is a side sectional view taken from FIG. 3B.
Figure 4:
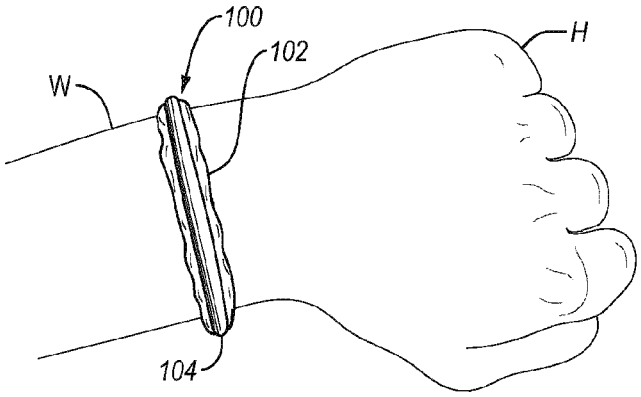
FIG. 4 is a top perspective view of the embodiment of FIG. 3A of a versatile jewelry protecting the skin from the compression of a hair accessory and distributing the pressure while enhancing the aesthetic appearance of the wrist.

As depicted in FIGS. 3D and 3E, at least one of the first and second opposing end portions 108, 110 defines a troughed portion 124, which encloses an end of the at least one retaining feature 112. The first and second opposing end portions 108, 110 may each define the troughed portion 124 enclosing the at least one retaining feature 112. The groove may terminate short of the first and second end portions 108, 110, and the at least one hair accessory 104 is arranged to extend over an end 126 of first and second end portions 108, 110. The first and second end portions 108, 110 may suspend the at least one hair accessory 104 at a height above the at least one retaining feature 112 across the clearance 106.

The main body 102 may define upper and lower portions 114, 116 having decorative features. The upper and lower portions may have a non-uniform profile or contour 122 bordering at least one retaining feature 112. Alternatively, the decorative feature may result in a highly streamlined profile comprising substantially thinned upper and lower portions and a narrow groove forming the at least one retaining feature. At least one of the upper and lower portions may include attractive features secured thereon such as diamonds, colored beads, crystals, and other known types, and which do not interfere with the at least one retaining feature 112 and do not impede removal of the at least one hair accessory 104.

Figure 5:
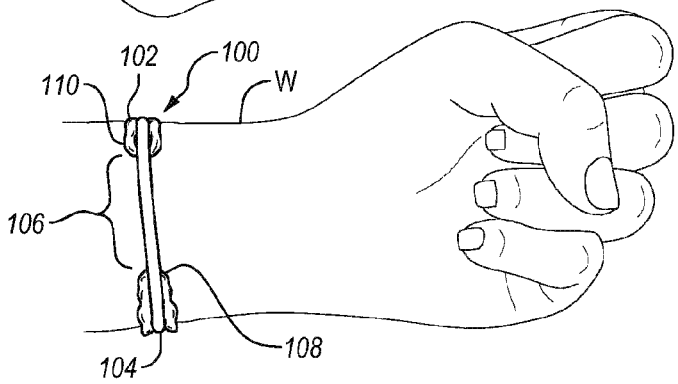
FIG. 5 is a rear perspective view of the embodiment of FIG. 3A on a wrist showing a clearance defined by a main body of the versatile jewelry.
Figure 7:
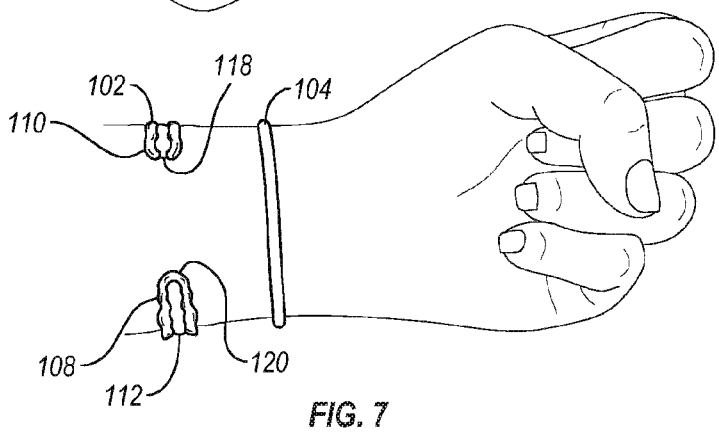
FIG. 7 is a schematic view of FIG. 6 showing a next step of removal of a hair accessory from the main body.

FIGS. 5 and 7 illustrate the first end portion 108 enclosing the at least one retaining feature in the form of a groove 112, and the second end portion 110 may open to the groove and direct the hair accessory 104 to the first end portion 108. The end portion 110 may have ends tapering toward the groove 112 to better retain the hair accessory relative to the main body 102.

Figure 6:
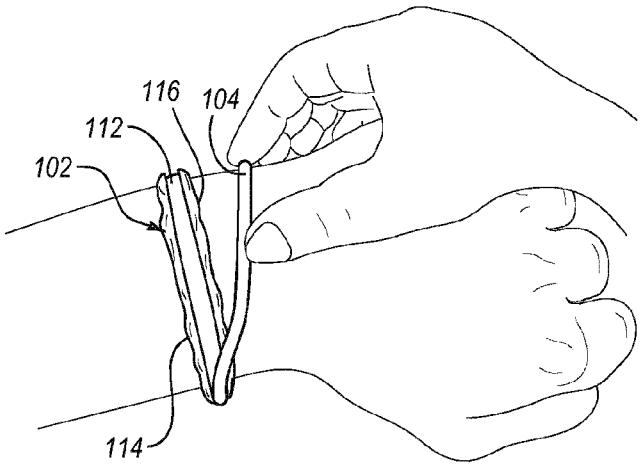
FIG. 6. is a schematic view of FIG. 4 showing a first step of removal of a hair accessory.

FIGS. 5-7 show how the hair accessory 104 can easily move off the main body 102 by intentional action of the user. A method for removing the hair accessory 104 involves pulling the hair accessory 104 from the clearance and disengaging the hair accessory 104 from the groove 112 to pull the hair accessory 104 away from the main body 102. The hair accessory 104 may be eventually pulled over the hand to use for the user's hair.

Figure 8A:
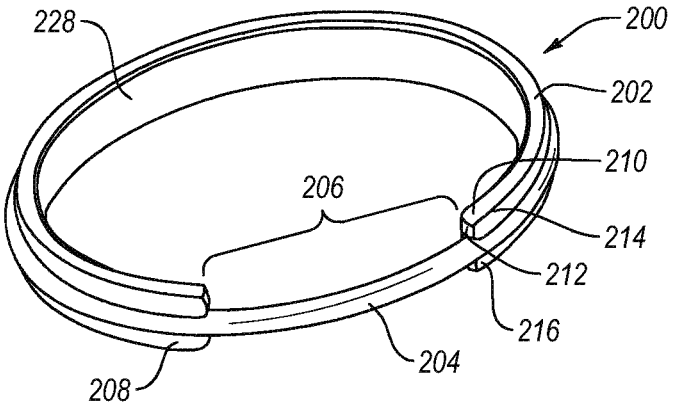
FIG. 8A is a front perspective view showing an embodiment of a versatile jewelry.
Figure 8B:
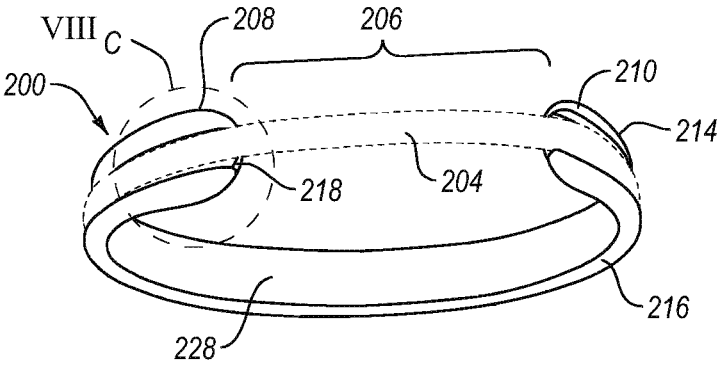
FIG. 8B is a rear perspective view of the embodiment of FIG. 8A.
Figure 8C:
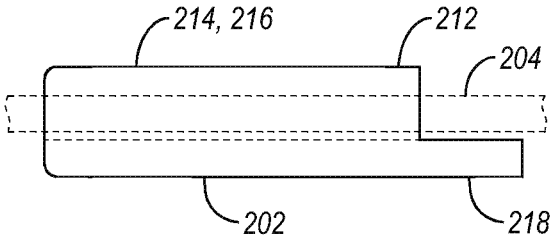
FIG. 8C is a side sectional view taken from FIG. 8B.

FIGS. 8A-8C disclose another embodiment of versatile jewelry 200 having a main body 202 and a hair accessory 204 in an elastic band. The main body 202 defines an inner surface 228 arranged to be worn against a wrist. A clearance 206 is defined between first and second end portions 208, 210, and at least one retaining feature 212 in the form of a groove opens at the end portions 208, 210. First or upper and second or lower portions 214, 216 subtend the groove 212.

FIG. 8C particularly shows how the end portions 208, 210 may include a ledge 218 protruding from the end portions 208, 210 to ease transition of the hair accessory 204 across the clearance 206.

Figure 9A:
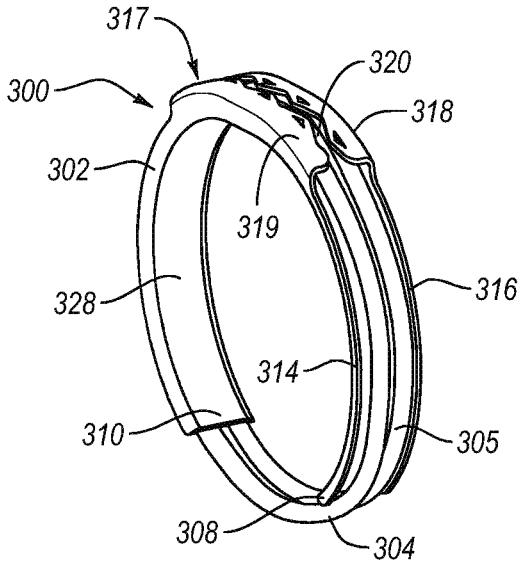
FIG. 9A is a front perspective view showing an embodiment of a versatile jewelry.
Figure 9B:
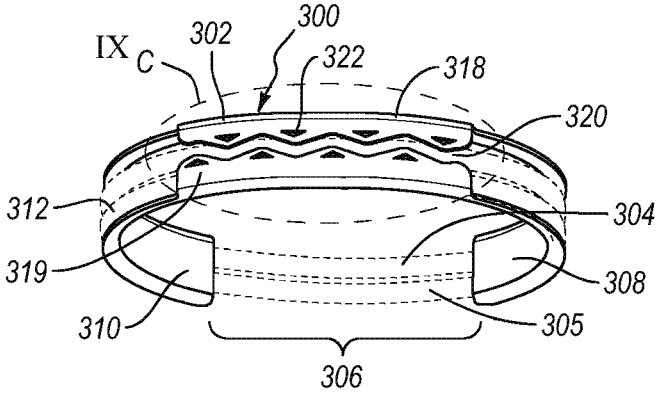
FIG. 9B is a rear perspective view of the embodiment of FIG. 9A.
Figure 9C:
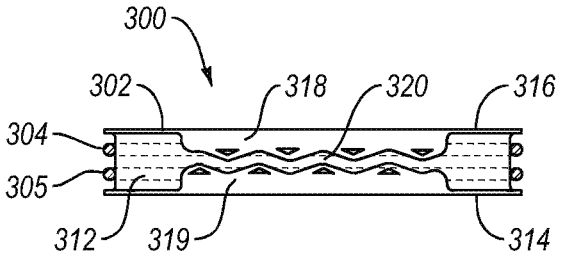
FIG. 9C is a front sectional view taken from FIG. 9B.

FIGS. 9A-9C disclose another embodiment of the versatile jewelry 300 having a main body 302 and a hair accessory 304 in the form of first and second elastic band 304, 305 within the at least one retaining feature 312. The main body 302 defines an inner surface 328 arranged to be worn against a wrist. A clearance 306 is defined between first and second end portions 308, 310, and at least one retaining feature 312. First or upper and second or lower portions 314, 316 subtend the groove 312, which is substantially widened over the previous embodiments to permit a single or multiple hair accessories 304.

In this embodiment, a sleeve 317 formed by first and second protruding portions 318, 319 is defined as radially extending outwardly from the main body 302 and over the groove 312. A gap or opening 320 is defined between the first and second protruding portions 318, 319. The gap 320 is configured and dimensioned to enable a user to place a hair accessory to slip therethrough and may be sized so the hair accessory must be thinned or lengthened to pass through the gap 320.

The gap 320 may form a non-linear shape according to how and where the first and second protruding portions 318, 319 face one another. The non-linear shape may prevent a hair accessory from sliding or slipping past the gap, and may be arranged in a decorative pattern. The protruding portions 318, 319 may include decorative features 322 such as designs or lettering (as in one's name, a company name or quote). The decorative features may be customized and vary from bracelet to bracelet.

Figure 10:
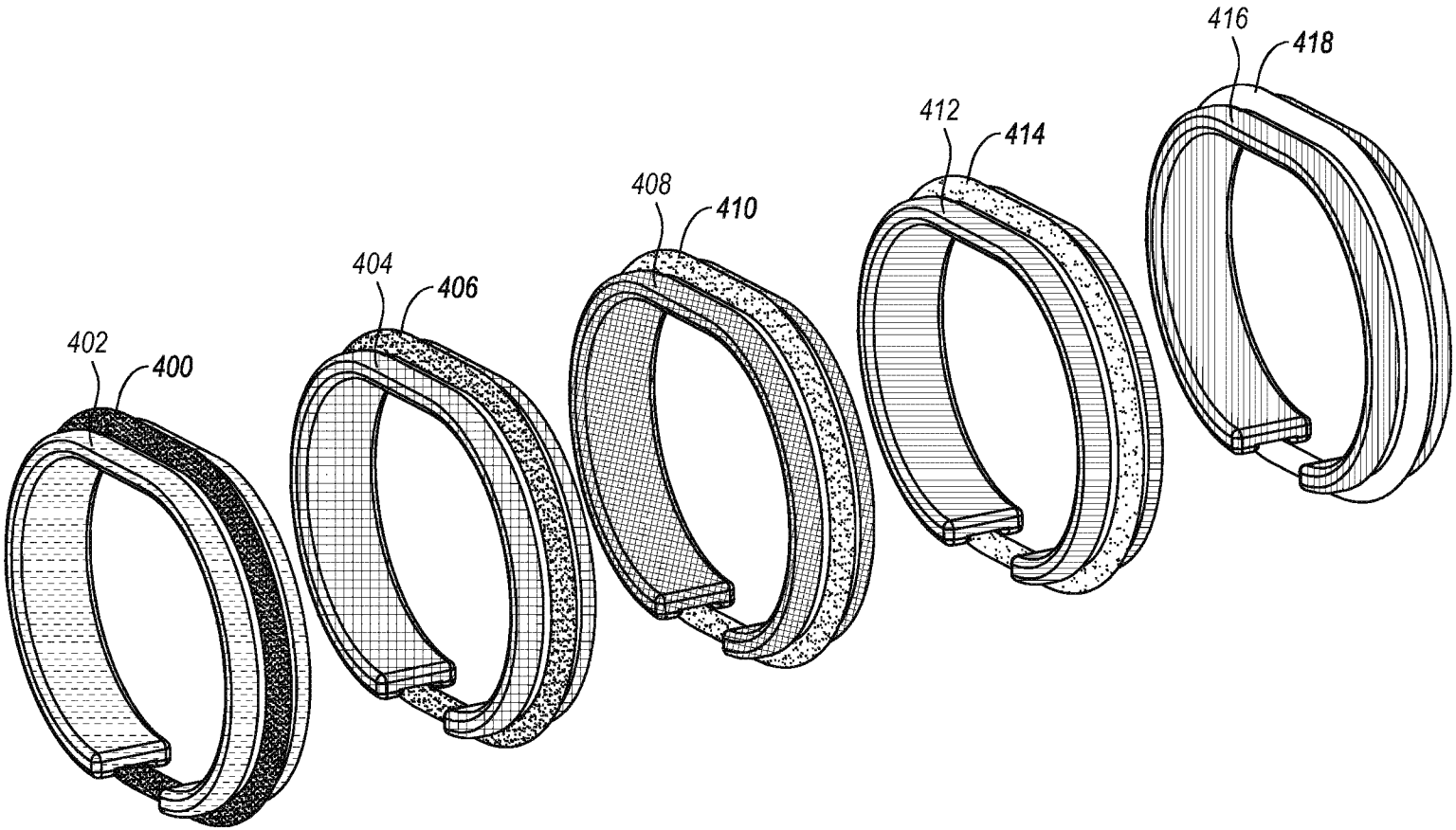
FIG. 10 is a perspective view showing a set of versatile jewelry.

FIG. 10 depicts a plurality of plastic main bodies 400, 404, 408, 412, 416 and 414, which may be coordinated with colors of different hair accessories 402, 406, 410, 414, 418. These main bodies may be constructed from a resilient plastic permitting expansion of the main body to be inserted onto a wrist and reversion to a predetermined shape once installed on a wrist in a relaxed configuration. Alternatively, the main body may be tensioned on a wrist should the wrist opening sized smaller than the wrist upon which it is worn. It may also be resilient to accommodate the hair accessories in the form of a band, which may compress the main body.

FIG. 11 shows an embodiment of a versatile jewelry 500 in which the main body 502 has a circumferential profile and a retaining feature 504 is formed by the main body 502. A clasp 506 is provided for opening the main body 502 and the retaining feature 504 is arranged to extend underneath the clasp 506 and can accommodate a hair accessory as described. The main body 502 may bear many the features described in connection with the preceding embodiments.

FIG. 12 describes another versatile jewelry 600 including a main body 602 and a retaining feature 604 formed by the main body 602. The main body 602 includes a sizing device with various slots 608 and tabs 606 adapted to vary and lock the size of the main body 602 on a user's wrist. The main body 602 may include a display 610 such as a clock, notification, etc.

Any of the preceding embodiments may be incorporated into a standard activity monitor bracelet such as Nike Fuelband, Jawbone Up and Fitbit Force or Flex.

Figure 13A:
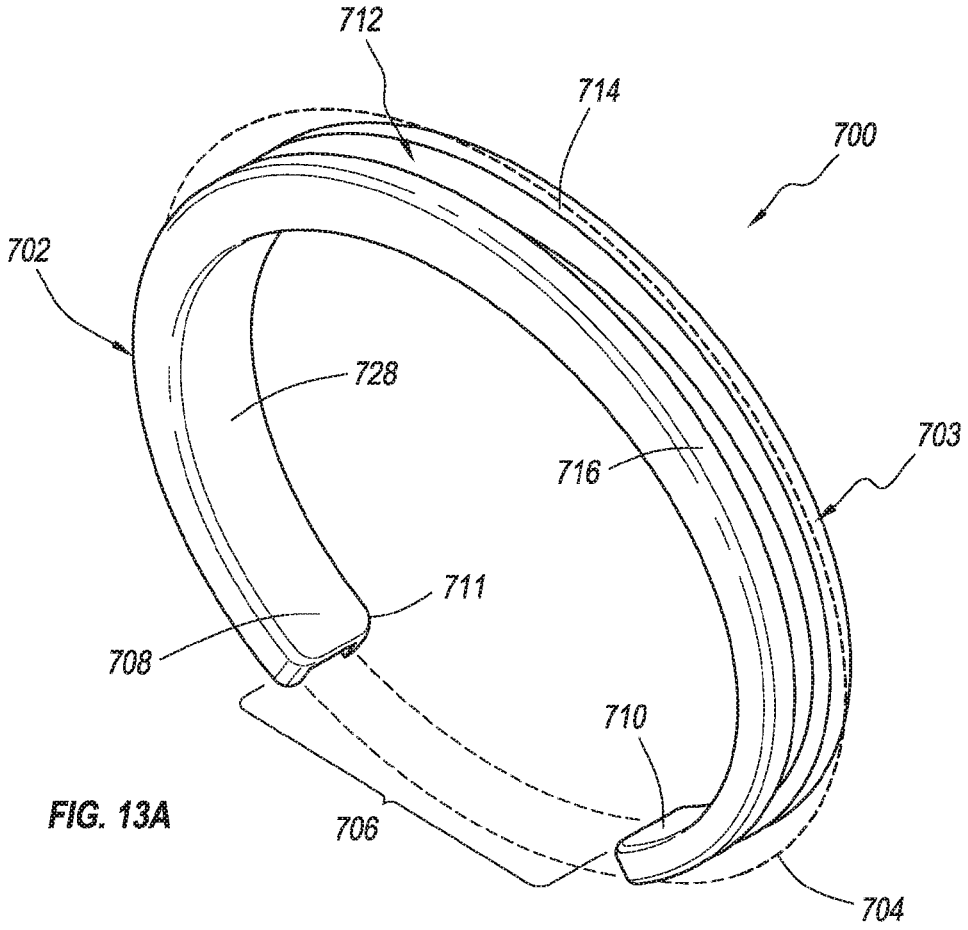
FIG. 13A is a perspective view showing another embodiment of a versatile jewelry.

FIGS. 13A-13E describe another versatile jewelry 700 comprising a bracelet 700. It will be appreciated that the bracelet 700 can include any of the features described above. As seen in FIG. 13A, the bracelet 700 includes a semi-rigid or rigid main body 702 and at least one retaining feature 704 defined about the outer periphery thereof between first or upper and the second or lower portions 714, 716. The main body 702 can define first and second opposing end portions 708, 710 with a clearance 706 therebetween to form an open cuff design. The clearance 706 allows for the bracelet 700 to be easily donned while ensuring that it stays well on the arm during various activities. The first and second opposing end portions 708, 710 may each include a radius 711, helping to increase the comfort and safety of the bracelet 700.

Figure 13B:
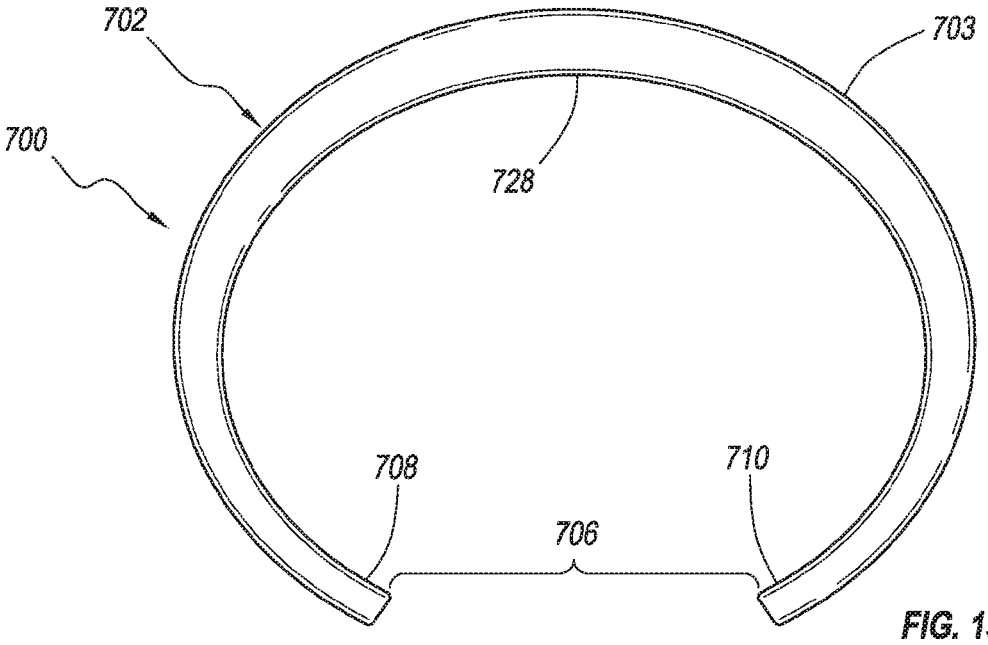
FIG. 13B is a side view of the embodiment of FIG. 13A.

The main body 702 can have any suitable shape but is shown having a semi-elliptical or oval profile as seen in FIG. 13B. The main body 702 defines an inner surface 728 arranged to be worn against the wrist. The inner surface 728 can have an anatomical shape arranged to more natural fit over a user's wrist.

At least one hair accessory 704, such as a hair tie or elastic band, is adapted to extend over the main body 702 and arranged to be secured by the at least one retaining feature 712. The main body 702 retains the hair accessory 704 therewith and the hair accessory 704 spans the periphery of the main body 702 and the clearance 706.

Similar to the previously described embodiments, the semi-rigid or rigid main body 702 is arranged to resist the elasticity of the at least one hair accessory 704 without deformation. For instance, the main body 702 can substantially maintain its shape under the force created by the tension of the hair accessory 704 and lift the at least one hair accessory 704 off the user's wrist or allow it to only apply a minimal or desirable amount of pressure in certain areas wherein the bracelet 700 does not cover the arm. The main body 702 also provides the advantage of distributing from the force created by the tension of the hair accessory 704, partially or completely around the wrist.

The main body 702 can have a malleable or resilient configuration, allowing it to be formed or shaped to accommodate an individual's wrist. For instance, the main body 702 can be formed of a metal material shapeable or pliable without breaking or cracking to fit the user's wrist (e.g., gold, platinum, copper, aluminum, etc.) while also having a rigidity arranged to maintain the shape of the main body 702 under the force of the hair accessory 704 and to lift the hair accessory 704 off the user's wrist.

In other embodiments, the main body 702 can be formed of a resin (e.g., plastic) and/or metal material having a resilient configuration such that the opposing end portions 708, 710 can be moved or flexed apart to help position the main body 702 on the user's wrist while also having a rigidity arranged to maintain the shape of the main body 702 under the force of the hair accessory 704. As such, the bracelet 700 can protect the user's arm or wrist from poor blood circulation, pressure marks, and provide a carrier to maintain hair accessories.

The at least one retaining feature 712 may be a groove 712 formed into the outer surface 703 of the main body 702 and extending about its length or circumference. The groove 712 is shown in FIG. 13C having a substantially quadrilateral or rectangular cross section but may have any shape suitable to retain the hair accessory therein.

The groove 712 can define a pair of flat upstanding sidewalls 718 and a flat bottom portion 720 extending between the sidewalls 718. It should be appreciated that the groove 712 can define a chamfer or fillet between the bottom portion 720 and the sidewalls 718 and/or between the sidewalls 718 and the outer surface 703 of the main body 702.

The flatness of the bottom portion 720 along its cross section results in the compressive pressure from the hair accessory 704 being substantially perpendicular to the bottom of the groove 712. This in effect maintains the force of the hair accessory 704 substantially normal to the bottom of the groove 712, which, in turn, reduces the likelihood of the hair accessory 704 forcing or pulling itself toward one side or the other within the groove 712, helping to keep the hair accessory 704 in the groove 712 and on the bracelet 700. The groove 712 defines a width Gw between the sidewalls 718 to ensure that the hair accessory 704 does not slip from the bracelet 700 and therefore proper distribution of pressure from the hair accessory is ensured. The width Gw can be greater than a width of the hair accessory 704. The width Gw can be constant. The width Gw can vary. Optionally, the transition between the bottom portion 720 and the sidewalls 718 can define a radius.

Figure 13C:
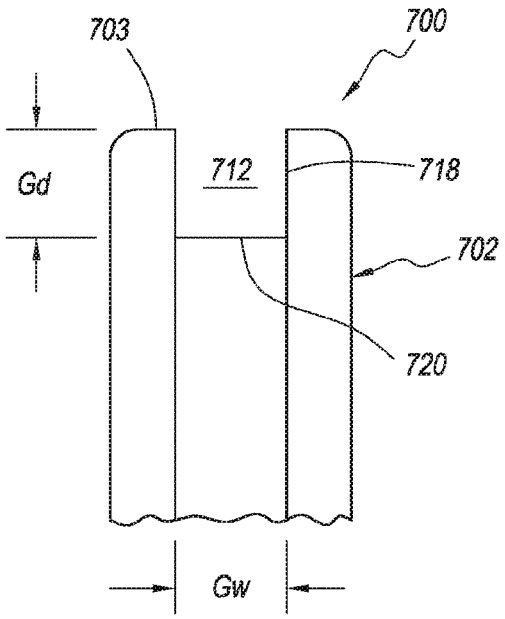
FIG. 13C is a front sectional view of the embodiment of FIG. 13A.
Figure 13D:
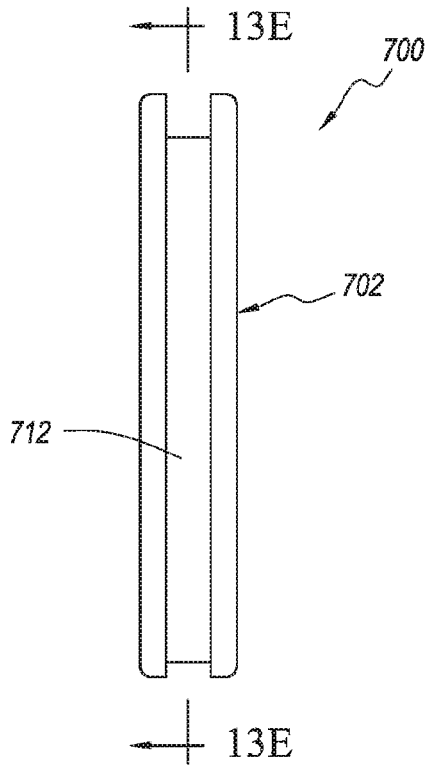
FIG. 13D is a front view of the embodiment of FIG. 13A.
Figure 13E:
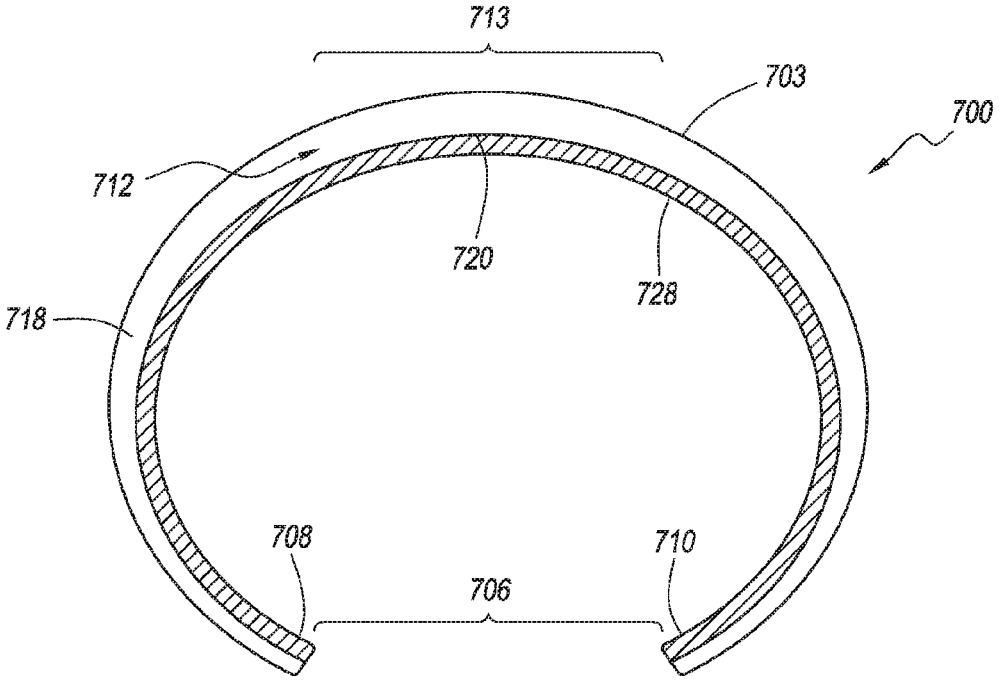
FIG. 13E is a cross-sectional view taken along line 13E-13E shown in FIG. 13D.

Referring to FIGS. 13C-13E, the groove 712 has a depth Gd defined between the bottom portion 720 and the outer surface 703 of the main body 702. The magnitude of the depth Gd relative to the width Gw can be selected to help retain the hair accessory 704 in the groove 712. The depth Gd can be greater than about 0.8, about 1, about 1.2, about 1.4, about 1.6, about 1.8, or about 2 times the width Gw of the groove 712. In other embodiments, the depth Gd relative to the width Gw of the groove 712 can be greater or smaller.

The depth Gd of the groove 712 can generally correspond to a height of the sidewalls 718. In an embodiment, the depth Gd of the groove 712 can be selected to reduce the likelihood of the hair accessory 704 jumping or moving along the sidewalls 718 and out of the groove 712. In an embodiment, the depth Gd of the groove 712 can be greater than about 0.3, about 0.5, about 0.7, about 0.9, about 1, about 1.2, about 1.4, about 1.6, about 1.8, or about 2 times the cross-sectional height of a hair accessory disposed in the groove 712. This provides a greater contact surface between the sidewalls 718 and the hair accessory while the hair accessory is disposed in the groove 712, helping to retain the hair accessory within the groove. In other embodiments, the depth Gd can be greater or smaller relative to the cross-sectional height of the hair accessory.

Furthermore, the sidewalls 718 can be substantially perpendicular to the bottom portion 720. This allows the sidewalls 718 to provide greater resistance to movement of the hair accessory out of the groove 712 as sidewalls 718 are more difficult for the hair accessory to climb or move along than a sloped or curving sidewall.

According to a variation, the groove 712 has a varying depth Gd. As seen in FIG. 13E, the depth Gd of the groove 712 can increase from the ends portions 708, 710 toward a middle portion 713 of the groove 712 generally opposite the clearance 706*t*. The depth Gd of the groove 712 at or near the middle portion 713 can be greater than about 1.2, about 1.4, about 1.6, about 1.8, about 2, or about 2.2 times the depth Gd of the groove 712 at or near the end portions 708, 710. In other embodiments, the depth Gd of the groove 712 at or near the middle portion 713 can be greater or smaller relative to the depth Gd of the groove 712 at or near the end portions 708, 710.

The groove 712 can define a greater depth Gd where the radius of curvature of the groove 712 and the main body 702 is larger, across the top of the wrist. This advantageously can help hide more of the hair accessory in the groove 712 where it is most visible to a casual observer, providing an aesthetically pleasing look. It can also more securely retain the hair accessory in the groove 712 by locating the hair accessory deeper in the groove 712, reducing the likelihood of inadvertent displacement by bumping, rubbing, or the like. In other embodiments, the maximum depth Gd of the groove 712 can be defined toward the end portions 708, 710 or along the sides of the main body 702.

Not necessarily all such objects or advantages may be achieved under any embodiment of the invention. Those skilled in the art will recognize that the invention may be embodied or carried out to achieve or optimize one advantage or group of advantages as taught without achieving other objects or advantages as taught or suggested.

The skilled artisan will recognize the interchangeability of various components from different embodiments described. Besides the variations described herein, other known equivalents for each feature can be mixed and matched by one of ordinary skill in this art to construct a versatile jewelry under principles of the present invention.

Although this invention has been disclosed in certain preferred embodiments and examples, it will be understood by those skilled in the art that the present invention extends beyond the disclosed embodiments to other alternative embodiments and/or uses of the invention and obvious modifications and equivalents thereof. It is intended that the present invention disclosed should not be limited by the disclosed embodiments described above, but should be determined only by a fair reading of the claims that follow.

The invention claimed is:

1. A versatile jewelry comprising:

a semi-rigid or rigid main body having a semi-elliptical profile and arranged to extend over a wrist of a use, the main body defining an inner surface arranged to be worn against the wrist, an outer surface opposite the inner surface, a groove in the outer surface, and first and second end portions with a clearance therebetween, the groove having a varying depth along a length thereof and a cross section having a flat bottom portion and a pair of flat upstanding sidewalls oriented substantially perpendicular to the bottom portion; and at least one hair accessory adapted to be selectively disposed within the groove and to span the periphery of the main body and the clearance, the at least one hair accessory having an elasticity and the main body having a rigidity arranged to distribute pressure from the at least one hair accessory away from the wrist, wherein the elasticity of the at least one hair accessory forces the at least one hair accessory against the bottom portion of the groove and the sidewalls restrict lateral movement of the at least one hair accessory within the groove to secure the at least one hair accessory within the groove.

2. The versatile jewelry of claim 1, wherein the force of the at least one hair accessory on the bottom portion of the groove is substantially normal to the bottom portion.

3. The versatile jewelry of claim 1, wherein the depth of the groove increases from the first and second end portions toward a middle portion of the groove located opposite the clearance.

4. The versatile jewelry of claim 3, wherein the depth of the groove at or near the middle portion is greater than about 2 times the depth of the groove at or near the first and second end portions.

5. The versatile jewelry of claim 1, wherein the groove defines a width between the sidewalls and a depth between the bottom portion of the groove and the outer surface of the main body, and the depth of the groove is greater than about 1.2 times the width of the groove.

6. The versatile jewelry of claim 5, wherein the depth of the groove is greater than about 1.4 times the width of the groove.

7. The versatile jewelry of claim 5, wherein the depth of the groove is greater than about 1.6 times the width of the groove.

8. The versatile jewelry of claim 1, wherein the first and second end portions define a radius.

9. The versatile jewelry of claim 1, wherein the main body is malleable to accommodate a shape of the wrist and the rigidity of the main body is arranged to maintain a shape of the main body under the force of the at least one hair accessory on the bottom portion of the groove.

10. The versatile jewelry of claim 1, wherein the main body is formed of a metal material.

11. The versatile jewelry of claim 1, wherein the main body is formed a plastic material.

12. The versatile jewelry of claim 1, wherein the first and second end portions suspend the at least one hair accessory at a height above the at least one retaining feature across the clearance.

13. The versatile jewelry of claim 1, wherein the bottom portion of the groove is substantially concentric with the inner surface of the main body.

14. The versatile jewelry of claim 1, wherein the first and second end portions are movable relative to one another.

15. The versatile jewelry of claim 1, wherein the groove defines a chamfer between the bottom portion and the sidewalls of the groove.

16. A versatile jewelry for supporting at least one hair accessory, the versatile jewelry comprising:

a semi-rigid or rigid main body arranged to extend over a wrist of a use, the main body defining an inner surface arranged to be worn against the wrist, an outer surface opposite the inner surface, a groove in the outer surface dimensioned and configured to receive an elastic hair band, and first and second end portions with a clearance therebetween, the groove having a varying depth along a length thereof and a cross section including a flat bottom portion and a pair of flat upstanding sidewalls oriented substantially perpendicular to the bottom portion.

17. The versatile jewelry of claim 16, wherein the main body defines a semi-oval profile.

* * * * *